United States Patent [19]

Cordella

[11] 4,411,304

[45] Oct. 25, 1983

[54] DRIVING ROLLER STAND FOR CONTINUOUS CASTING PLANTS

[75] Inventor: Johannes Cordella, Linz, Austria

[73] Assignee: Voest-Alpine Aktiengesellschaft, Linz, Austria

[21] Appl. No.: 251,246

[22] Filed: Apr. 6, 1981

[30] Foreign Application Priority Data

Apr. 15, 1980 [AT] Austria ..... 2026/80

[51] Int. Cl.[3] ..... B22D 11/12; B60B 15/16

[52] U.S. Cl. ..... 164/448; 29/115

[58] Field of Search ..... 164/442, 448, 484; 29/115, 124; 193/35 R; 226/186

[56] References Cited

U.S. PATENT DOCUMENTS

| | | | |
|---|---|---|---|
| 3,965,975 | 6/1976 | Sernetz et al. | 164/448 |
| 4,036,284 | 7/1977 | Hoffman | 164/442 X |
| 4,106,550 | 8/1978 | Tsuchida | 164/448 |
| 4,131,153 | 12/1978 | Schmid | 164/442 |

FOREIGN PATENT DOCUMENTS

| | | |
|---|---|---|
| 1483664 | 2/1970 | Fed. Rep. of Germany . |
| 2721856 | 1/1977 | Fed. Rep. of Germany . |
| 2702894 | 7/1977 | Fed. Rep. of Germany . |
| 2733864 | 9/1978 | Fed. Rep. of Germany . |

*Primary Examiner*—Nicholas P. Godici
*Assistant Examiner*—Jerold L. Johnson
*Attorney, Agent, or Firm*—Brumbaugh, Graves, Donohue & Raymond

[57] ABSTRACT

In a driving roller stand for continuous casting plants with at least two adjacently arranged strand guides, at least one separately arranged driving roller is provided for each of the strands. A first driving roller is designed as a hollow construction unit with a first driving element. A driving shaft provided with a second driving element, of a second driving roller coaxially arranged with the first one penetrates this hollow construction unit. Each of the driving rollers is separately arranged on the driving roller stand. In order to be able to arrange the strands as closely adjacent as possible in such a driving roller stand, the driving shaft is engageable out of and in both the second driving roller and the second driving element and is axially removable out of and installable into the hollow construction unit of the first driving roller.

5 Claims, 8 Drawing Figures

DRIVING ROLLER STAND FOR CONTINUOUS CASTING PLANTS

BACKGROUND OF THE INVENTION

The invention relates to a driving roller stand for continuous casting plants with at least two adjacently arranged strand guides, in particular continuous casting plants for steel billets, comprising at least one separately driven driving roller for each of the strands, a first driving roller being designed as a hollow construction unit with a first driving element and a driving shaft provided with a second driving element of a second driving roller that is arranged coaxially with the first driving roller penetrating this hollow construction unit, each driving roller furthermore being separately journaled on the driving roller stand.

With multiple continuous casting plants it is desirable to arrange the strand guides for the individual strands as closely adjacent to each other as possible in order to keep the size of the common tundish arranged above all the moulds as small as possible, thus minimizing heat losses as well as the amount of space required for the continuous casting plant.

A driving roller stand of the initially-defined kind is known from German Offenlegungsschrift No. 1,483,664. With this stand an Oldham coupling is arranged between the first driving roller, which is designed as a hollow construction unit, and the neighbouring second driving roller, which Oldham coupling connects the neighbouring driving roller with the driving shaft that penetrates the hollow construction unit. However, with this coupling it is not possible to arrange the individual strands closely adjacent one another. This known driving roller stand, therefore, exhibits an undesirably large construction width transverse to the longitudinal direction of the strand.

A driving roller stand having a space-saving, closely neighbouring arrangement of the two strand guides is known from German Offenlegungsschrift No. 27 02 894. With this stand, the driving shaft of the second driving roller is rigidly connected with this driving roller and rotatably journaled in the hollow construction unit of the first driving roller. This results in the disadvantage that the removal of one of the driving rollers necessitates the removal of the other driving roller, so that the casting operation cannot be maintained at one of the two strand guides. Also, the removal of both of the driving rollers, although damage has occurred to only one of the two driving rollers, is cumbersome and time-consuming. This arrangement also requires the use of several differently dimensioned antifriction bearings for journaling the driving rollers, which necessitates maintaining a stock of these different spare parts.

With the multiple continuous casting plant known from German Auslegeschrift No. 27 21 856, one driving shaft each reaches from the driving motors arranged laterally of the plant to each of the driving rollers provided at the strand guides, from the outside, and connects the same with the respective driving roller by means of a chain drive or a coupling arranged immediately beside the respective strand guide. This has the disadvantage that the strand guides can no longer can be arranged very closely adjacent to each other because the driving elements are situated between the strand guides, and the couplings or driving elements situated between the strands are subjected to the immediate heat influence of the strands.

A further possible arrangement of the driving rollers in multiple continuous casting plants is shown in German Offenlegungsschrift No. 27 33 864, where each of the driving rollers is directly connected by means of a driving shaft. There, the driving rollers, however, are not arranged coaxially, but lie one behind the other in the strand extraction direction. This results in a greater construction length of the plant.

SUMMARY OF THE INVENTION

The invention aims at avoiding the disadvantages and difficulties described, and has as its object to provide a driving roller stand of the initially-defined kind, which makes possible a very closely adjacent arrangement of the strand guides, the strand guide being as short as possible in the strand extraction direction, and wherein it is no longer necessary to remove several driving rollers in the event only one has been damaged and is in need of repair or replacement.

This object is achieved according to the invention in that the driving shaft is engageable with, and disengageable from, both the second driving roller and the second driving element, and is axially removable from, and installable into, the hollow construction unit of the first driving roller.

A preferred embodiment is characterized in that the driving shaft is connected both with the second driving roller and with the driving element allocated to the same, by means of multi-groove connections, the driving shaft advantageously being secured against axial displacement on the driving element allocated to it.

Suitably, a peripheral groove is provided on the driving shaft as securing means of the driving shafts against displacement, into which a diametrically divided disc engages, and which is detachably fastened to the second driving element allocated to the driving shaft.

It is of a particular advantage if the driving rollers are journaled on the driving roller stand by means of equally dimensioned bearings.

BRIEF DESCRIPTION OF THE DRAWINGS

The invention will now be explained in more detail by way of several embodiments and with reference to the accompanying drawings, wherein.

DESCRIPTION OF EXEMPLARY EMBODIMENTS

Figure 1:
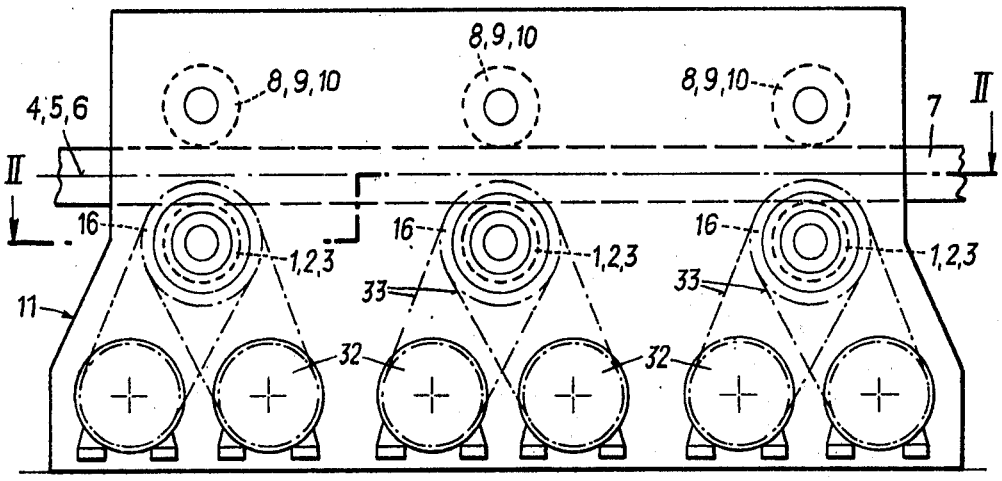
FIG. 1 is a schematic side view of a driving roller stand according to the invention.

The driving rollers 1, 2 and 3 of a triple continuous casting plant are arranged on the lower side of three neighbouring strand guideways. Each of the strands 7 extracted at one of the three neighbouring strand guideways having the central lines 4, 5, 6 is extracted by three driving rollers arranged one behind the other in the axial direction of the strand (for the purpose of a better transmission of the extraction forces). The strand guideways are parallel to one another and are arranged as closely adjacent as possible. Above each of the driving rollers, counter rollers 8, 9, 10 are provided. Each of the driving rollers 1, 2 and 3 is journaled individually on the driving roller stand 11 independently of the other neighbouring driving rollers by means of two antifriction bearings 13 which are arranged closely at a cylindrical section 12 which is in contact with the strand. The hollow driving rollers 1 and 3 of the two outer strand (FIG. 2) guideways are designed to be equal. Each of them comprises a tubular extension 14 projecting beyond the outer antifriction bearing 13, on which a driving element, which is designed as a chain wheel 16, is mounted by means of a feather key 15 or a wedge. This chain wheel 16 leans against the outer antifriction bearing 13 by means of a distance sleeve 17 and is secured against axial displacement on the extension 14 by means of a ring 18, thus forming a hollow construction unit with the respective driving roller 1 or 3. The hollow driving roller 2 of the middle strand guide (having the central line 5) does not project beyond its antifriction bearings 13. In its cavity 19 it possesses a multi-wedge section 20 in which a multi-wedge section 21 of a driving shaft 22 coaxially projecting outwardly through the hollow construction unit of the driving roller 1 engages. This driving shaft 22, on its outer end, also comprises a multi-wedge section 23, which coacts with a multi-wedge section 24 of a sleeve 25. This sleeve 25 also is journaled on the driving roller stand 11 by means of two antifriction bearings 26 and carries a driving element designed as a chain wheel 16 between these antifriction bearings 26, the driving element being mounted on the sleeve 25 in a rotationally fast manner by means of a feather key 15 or a wedge. All of the antifriction bearings 13 and 26 are outwardly protected by means of a cover 28 provided with a seal 27 and fixed to the driving roller stand with one bearing lid each. All of the bearings 13, 26 are of equal dimension.

On the outer end of the driving shaft 22 an extension 30 comprising an annular groove 29 is provided into which a dividedly designed disc 31 engages, which is detachably fastened to the outer end side of the hollow sleeve 25. This disc 31 prevents the driving shaft 22 from being axially displaced.

A separate motor 32 is provided to drive each of the chain wheels 16, each of which is connected with the respectively allocated chain wheel 16 by means of a driving chain 33 via a driving shaft on whose end a chain wheel also is mounted.

The removal of a driving roller is effected in the following manner: If, for instance, the middle driving roller 2 has been damaged and is to be exchanged, the divided disc 31 is removed, the driving shaft 22 is axially displaced until it comes to lie outside this driving roller 2 in the axial direction, whereupon the driving roller 2 with its bearings 13 can be lifted after having detached the bearing lids 34 of the bearings 13. No manipulations whatsoever need be carried out on the two neighbouring driving rollers 1 and 2 when carrying out this work. It is possible, in case of a damage to the middle driving roller, to maintain the casting operation at the two outer strand guideways until the tundish or the casting ladle from which the tundish is supplied will be emptied.

If the driving roller 1, which is penetrated by the driving shaft 22, is to be removed, it merely is necessary to displace the driving shaft 22 axially, after having detached and removed the divided disc 31, until it is removed from the hollow construction unit of this driving roller 1, comprised of the driving roller and the chain wheel, whereupon the hollow construction unit can be removed from the stand. The middle driving roller 2 (and also the driving roller 3) in this case may be retained in the driving roller stand 11.

Figure 4:
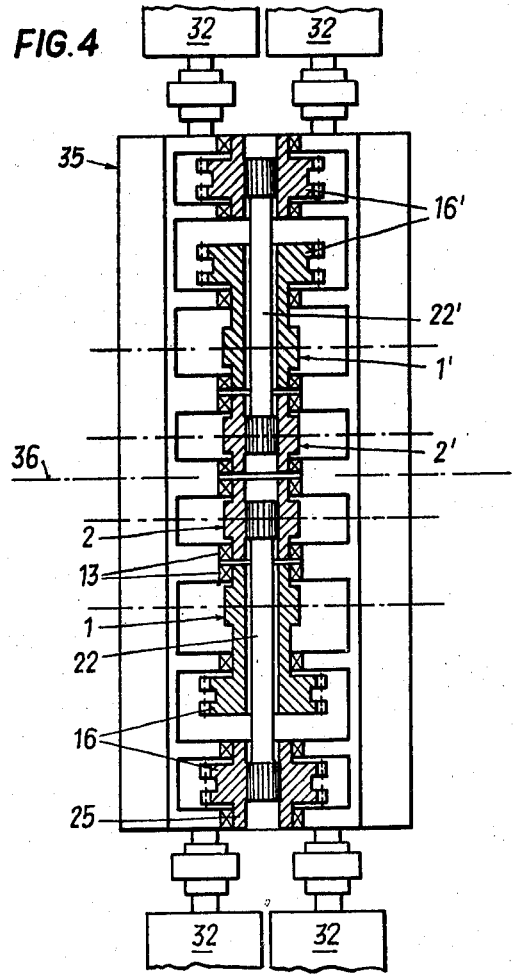
FIGS. 3 and 4, FIGS. 5 and 6, and FIGS. 7 and 8 represent further embodiments in illustrations analogous to those of FIGS. 1 and 2, respectively.
Figure 3:
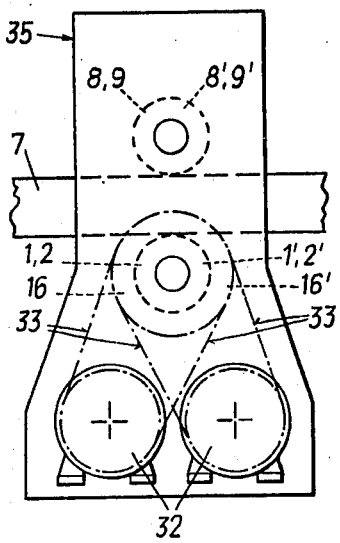

In FIGS. 3 and 4 a driving roller stand 35 for a quadruple continuous casting plant is shown, in which all four driving rollers 1, 2, 1', 2' are arranged with aligning axes, a particularly short construction length of the driving roller stand 35 (in the strand extraction direction) thus being possible.

For a continuous casting plant comprising only two strand guides, the driving rollers 1, 2 or 1', 2' on one side of the symmetrical axis 36 may be omitted. Such a plant has the advantage that both motors 32 are arranged on one side of the driving roller stand 35 only.

Figure 6:
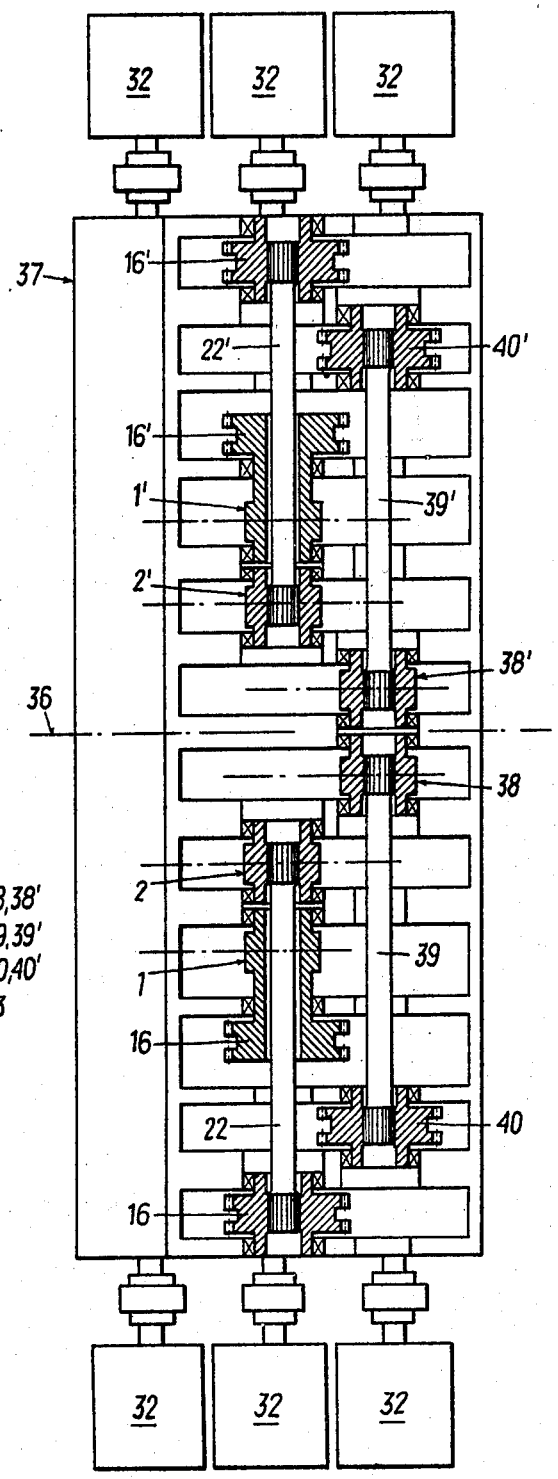
Figure 5:
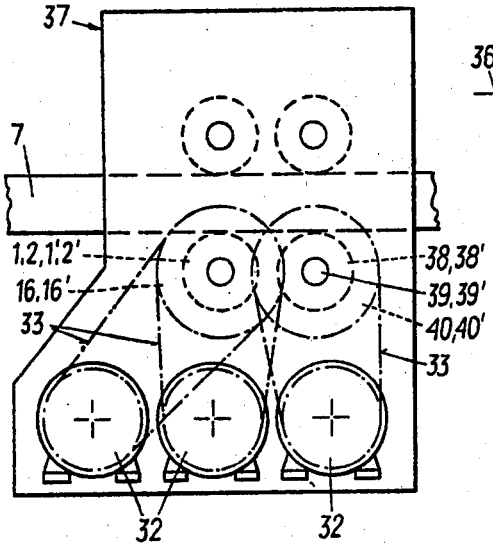

In FIGS. 5 and 6 an embodiment of a driving roller stand 37 for a sextuple continuous casting plant is illustrated, which may also be used for a triplex continuous casting plant if the driving rollers 1, 2, 38 or 1', 2', 38' on one side of the symmetrical axis 36 are omitted. Such a triplex continuous casting plant has the advantage that the motors 32 are arranged on one side of the continuous casting plant only, with two of the driving rollers 1, 2 or 1', 2' still being coaxially arranged, so that the construction length of the driving roller stand can be kept short, in the strand extraction direction.

The driving roller 38 (or 38'), with this driving roller stand 37, is designed in a manner similar to the roller 2. It is also connected with a chain wheel 40 via a driving shaft 39, so that, in case of a damage at the chain wheel 40, there is no need to remove the driving roller 38 or, vice versa, in case of a damage at the driving roller 38, there is no need to remove the chain wheel 40.

Figure 8:
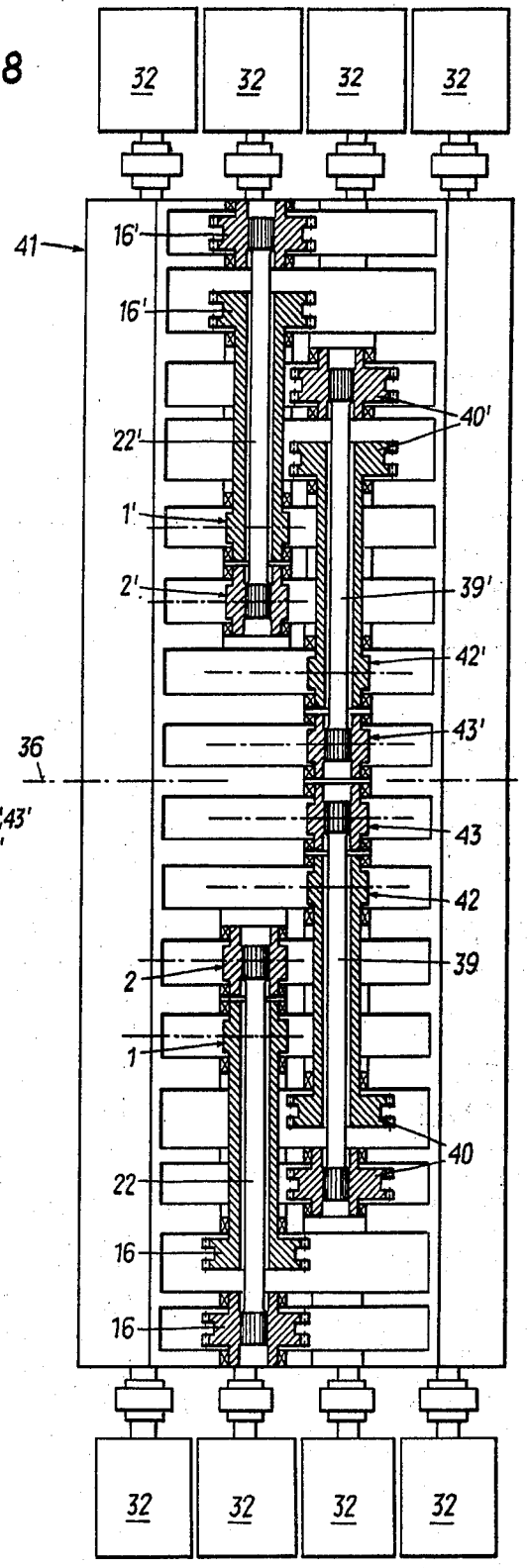
Figure 7:
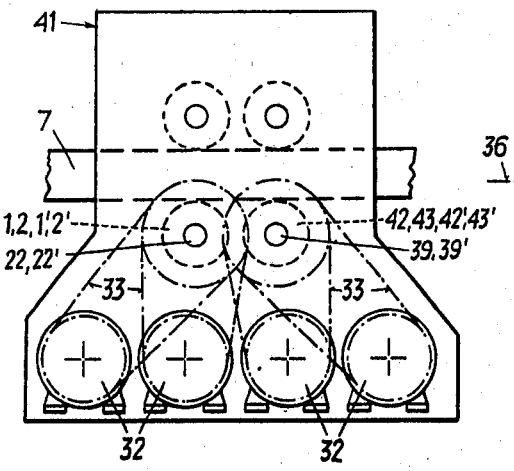

With the embodiment illustrated in FIGS. 7 and 8, of a driving roller stand 41, eight driving rollers 1, 2, 42, 43, 1', 2', 42', 43' for an octuple continuous casting plant are provided. When omitting the driving rollers on one side of the symmetrical axis of FIG. 8, one will obtain a driving roller stand for a quadruple continuous casting plant, in which all four driving motors again are arranged on one side of the continuous casting plant only. As can be seen from FIG. 8, four driving rollers 1, 2, 1', 2' and 42, 43, 42', 43' are each in alignment, which results in a very short construction length of the driving roller stand 41, in the extraction direction of the strand. As can be seen from FIG. 8, the driving rollers 42, 43 (and 42', 43') are designed in the same manner as the driving rollers 1, 2, and are also individually removable.

The invention is not limited to the embodiments illustrated in the drawings, but can be modified in various aspects. It may, for instance, be advantageous with particularly closely adjacent strand guides, if the first driving roller 1 (FIG. 2) of the hollow construction unit is cantilever-mounted on the driving roller stand and a bearing 13 is provided on either side of the driving unit mounted to the hollow construction unit. Thereby, the central lines 4 and 5 of the strand guideways can be placed closer by the bearing width of the bearing 13.

Figure 2:
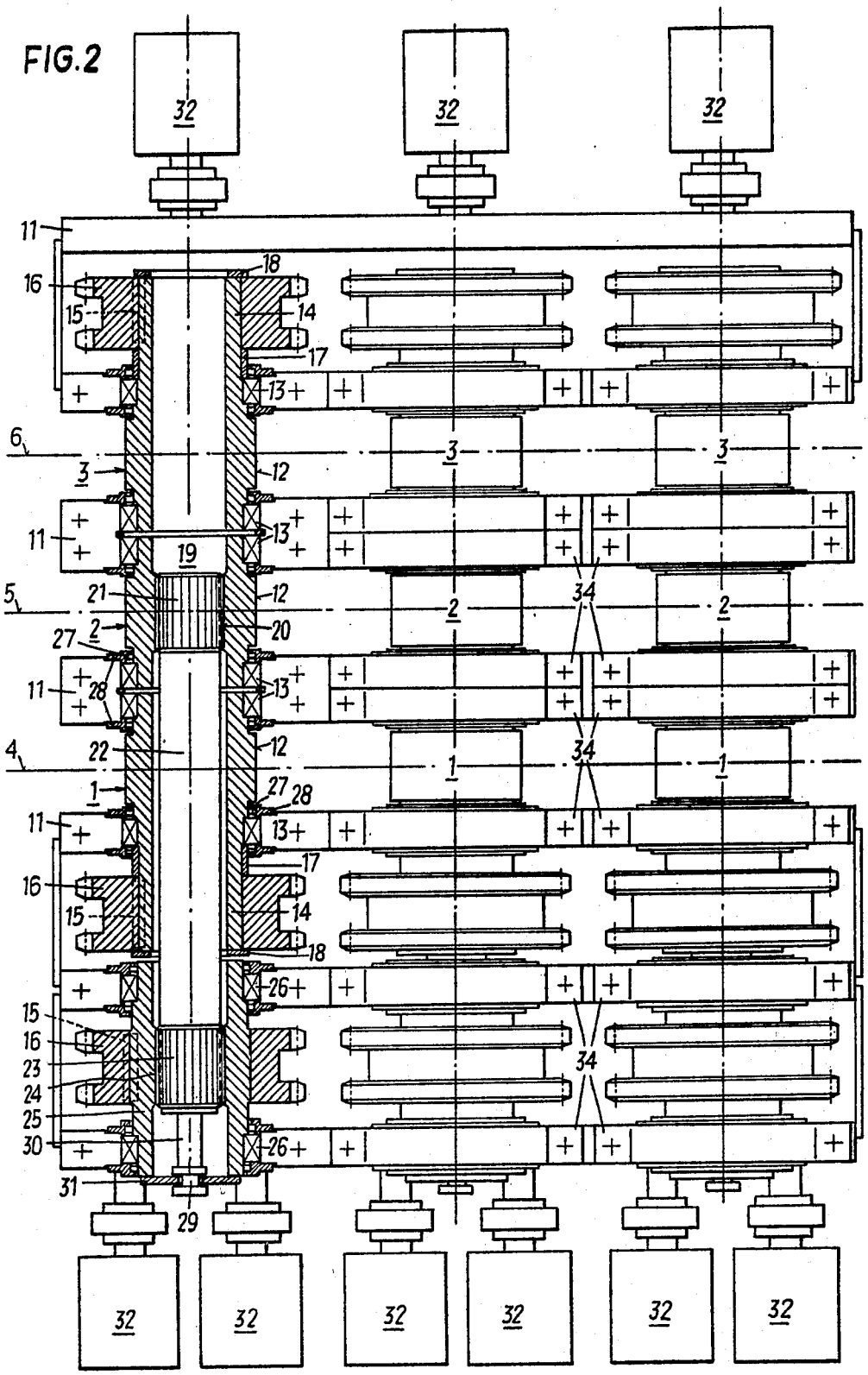
FIG. 2 is a sectional representation along line II—II of FIG. 1.

A further possibility of a suitable configuration of the driving roller stand may consist in that two driving units are allocated to the second driving roller 2 (FIG. 2), one driving unit 16 being provided as illustrated in FIG. 2 and a further driving unit being arranged on the other side of the strand guideways symmetrically to the central line 5. If it becomes necessary to remove the driving roller 1, the driving shaft 22 is displaced until it engages, with the multi-wedge section 23, into the multi-wedge section 20 provided at the driving roller 2 and the multi-wedge section 21 comes into engagement with a multi-wedge section provided on the further, oppositely arranged, driving unit. This driving unit is coupled with a driving motor of its own. Therefore, the driving roller 2 may continue to be driven even with a damage having occurred at the driving roller 1 of the hollow construction unit.

What I claim is:

1. In a driving roller stand arrangement for continuous casting plants having at least two adjacently arranged strand guides for casting at least two strands and comprising at least one separately driven drive roller for each strand, each driving roller being separately journaled on said driving stand, the arrangement including a first hollow driving roller having a first hollow driving element associated therewith, which first driving roller and first driving element define a hollow construction unit, a second driving roller having a second driving element associated therewith and being arranged coaxially with said first driving roller, and a driving shaft for driving said second driving roller, said driving shaft penetrating through said hollow construction unit, the improvement wherein:

said second driving roller and said second driving element are hollow and said driving shaft extends therethrough, and wherein there are provided within said second driving roller and said second driving element releasable engagement means which engage cooperating means on said driving shaft for rotation therewith, removal of said driving shaft simultaneously disengaging said second driving roller and said second driving element.

2. A driving roller stand arrangement as set forth in claim 1, further comprising multi-groove connections for connecting said driving shaft with said second driving roller and with said second driving element.

3. A driving roller stand arrangement as set forth in claim 1, wherein said driving shaft is secured against axial displacement at said second driving element.

4. A driving roller stand arrangement as set forth in claim 3, further comprising a peripheral groove provided in said driving shaft and a diametrically divided disc detachably fastened to said second driving element provided at said driving shaft, said diametrically divided disc engaging in said peripheral groove.

5. A driving roller stand arrangement as set forth in any of claims 2, 3, 4, or 1, further comprising equally dimensioned bearings for journaling said driving rollers on said driving roller stand.

* * * * *